United States Patent [19]

Babineaux

[11] 4,108,245

[45] Aug. 22, 1978

[54] WELL CABLE STOP FOR STRIPPING OPERATIONS

[76] Inventor: Lucien J. Babineaux, 734 N. Main St., St. Martinville, La. 70582

[21] Appl. No.: 827,783

[22] Filed: Aug. 25, 1977

[51] Int. Cl.[2] ..... E21B 31/10

[52] U.S. Cl. ..... 166/301; 166/99; 294/86.1

[58] Field of Search ..... 166/301, 209, 210, 211, 166/99; 294/86.1, 86.31

[56] References Cited

U.S. PATENT DOCUMENTS

| | | | |
|---|---|---|---|
| 3,011,549 | 12/1961 | Fredd et al. | 166/285 |
| 3,016,954 | 1/1962 | Crowell | 166/98 |
| 3,147,809 | 9/1964 | Thomas | 166/98 |
| 3,358,765 | 12/1967 | Le Blanc | 166/54.5 |

*Primary Examiner*—James A. Leppink
*Attorney, Agent, or Firm*—Clarence A. O'Brien; Harvey B. Jacobson

[57] ABSTRACT

A tubular sleeve structure defining an upwardly opening socket and including peripherally spaced inwardly retractable and spring biased outwardly projecting stop lugs is provided for positioning above and downward abutting engagement with a stop sleeve secured in the top of an overshot tool to be passed downwardly into a well bore over the supporting cable for a tool stuck in the well bore. An abutment is provided for securement to the cable from which the stuck tool is supported with the abutment positioned on the cable above the rig floor and closely below the portion of the cable to be engaged by upper and lower clamping as additional sections of pipe are added to the string of pipe by which the overshot is being lowered into the well bore over the cable. In the event the upper and lower clamping process of the cable experiences a malfunction and the cable is dropped downwardly through the tubing supporting the overshot, the abutment will abut the tubular sleeve structure supported at the bottom of the pipe string from the overshot tool and seat within the upwardly opening socket defined by the sleeve structure to thereby prevent the abutment and the cable to which the abutment is attached from falling further downwardly through the pipe string.

8 Claims, 9 Drawing Figures

18
26
10
24
12
16
22
28
68
20

18
14
12
24
22
26
28
20

28
48
50
7
7
60
68
20
54
48

36
34
6
30
40
38
16
32
38
6
34
40
36

26
5
5
32
30
42
44

34
26
40
32
30

50
52
52

54
56
56
54
48

48
48
28
54
52
4
4
50

34
40
32
40

62
28
58
52
20
60
54
54
56
68

WELL CABLE STOP FOR STRIPPING OPERATIONS

BACKGROUND OF THE INVENTION

In the oil production industry a tool is often lowered into a well bore to a depth of several thousand feet by means of a cable. On some occasions the tools become stuck and cannot be brought back up to the rig floor. In such instances, a process termed as "stripping" is undertaken. The cable supporting the tool is clamped above the rig floor in order to prevent the cable from falling into the bore and the cable is cut above the clamp. A special tool termed as an overshot is then secured to a section of pipe and the pipe section is then telescoped downwardly over that portion of the cable above the clamp and the cable is clamped above the pipe section to thus secure the cable in order that the lower clamp may be removed and the pipe section may be allowed to slide downwarly along the cable.

Additional sections of pipe are added to the pipe string by repeated upper and lower clamping of the cable with the result that the string of pipe will be lwered into the well bore around the cable until the overshot at the bottom at the string of pipe comes into contact with and "grabs" the stuck tool. Then, the cable is released from the stuck tool and withdrawn through the pipe and the pipe is then withdrawn from the well together with the overshot and the previously stuck tool supported from the overshot.

However, during the "stripping" process the upper and lower clamping of the cable can malfunction with the result that the cable is dropped and falls downwardly through the pipe and completely through the overshot tool to the bottom of the well bore.

The loss of the cable in the well bore represents a considerable loss in the value of the cable and also results in several thousand feet of cable dropping to the bottom of the well bore and causing considerable problems with future well operation. Accordingly, a need exists for a means whereby accidental dropping of the cable during a "stripping" operation will not result in the cable falling completely through the overshop supporting pipe string and the overshot down into the bottom of the well bore.

Examples of various forms of gripping tools including some of the general structural and operational features of the instant invention are disclosed in U.S. Pat. Nos. 3,011,549, 3,147,809 and 3,358,765. However, these previously patented gripping devices are not capable of performing the function of the structure of the instant invention.

BRIEF DESCRIPTION OF THE INVENTION

A tubular sleeve structure is provided for support from the upper portion of an overshot tool supported from the lower end of a pipe string being lowered into a well bore over a supporting cable for a tool to be retrieved by the overshot. In addition, an abutment is provided for secure attachment to the upper end of the cable below the upper and lower clamping positions thereon and the abutment, in the event the cable is accidentally dropped during upper and lower clamping operations thereon, is engageable with the tubular sleeve structure supported from the overshot to stop the falling of the cable downwardly through the well string supporting the over-shot and the latter.

The main object of this invention is to provide an apparatus whereby a cable dropped during a "stripping" operation may be prevented from falling completely through the overshot and down into the bottom of the associated well bore.

Yet another object of this invention is to provide an apparatus which may be readily adapted for use in conjunction with cables of different diameters and with overshot tools of different sizes.

Still another important object of this invention is to provide an apparatus which will not interfere with normal "stripping" procedures.

A final object of this invention to be specifically enumerated herein is to provide an apparatus in accordance with the preceding objects and which will conform to conventional forms of manufacture, be of simple construction and dependable in operation so as to provide a device that will be economically feasible, long lasting and relatively trouble free.

These, together with other objects and advantages which will become subsequently apparent, reside in the details of construction and operation as more fully hereinafter described and claimed, reference being had to the accompanying drawings forming a part thereof, wherein like numerals refer to like parts throughout.

DETAILED DESCRIPTION OF THE INVENTION

Figure 1:
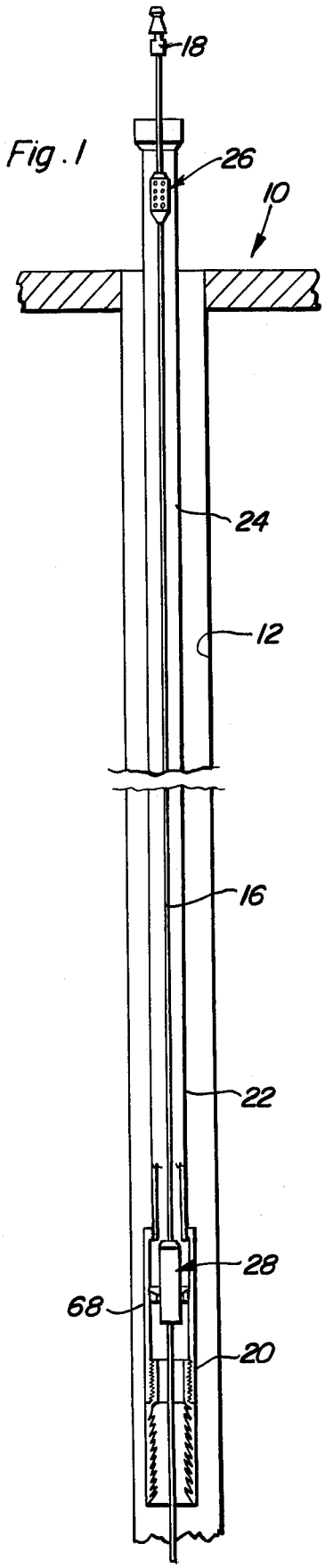
FIG. 1 is a fragmentary elevational schematic view illustrating the well cable stop structure of the instant invention operatively associated with an overshot supporting pipe string and the tool supporting cable extending through the string and the overshot.
Figure 2:
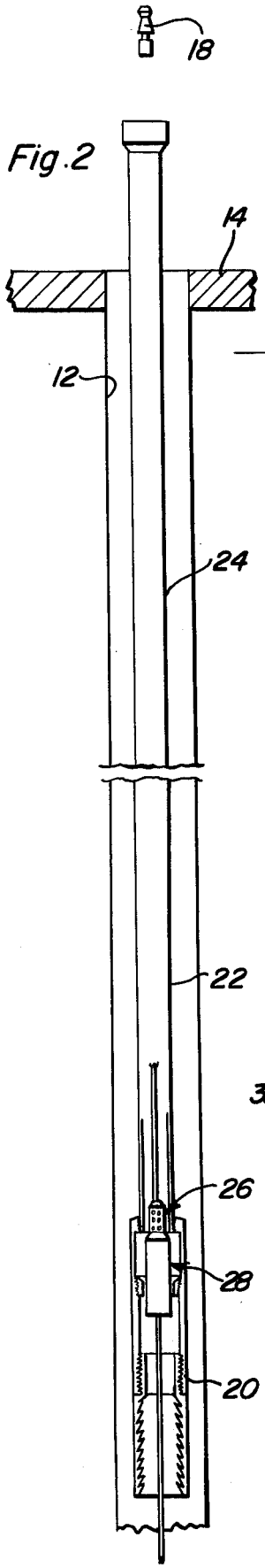
FIG. 2 is a fragmentary schematic elevational view similar to FIG. 1 but illustrating the manner in which the cable mounted abutment of the stop is operative to limit downward falling of the cable through the pipe string and the overshot tool supported therefrom in the event the cable is accidentally dropped.

Referring now more specifically to the drawings, the numeral 10 generally designates a well including bore 12 opening upwardly through a rig floor 14. A cable 16 extends downwardly into the bore 12 and supports a tool (not shown) from its lower end.

In the event the tool at the lowr end of the cable 16 becomes stuck, a "T clamp" is placed on the cable 16 at level of the rig floor and the cable 16 is cut 8 to 10 feet above this clamp, the cut end of the cable being inserted into a holding or clamping device called a rope socket. Thereafter, a tubular tool 20 is secured to the lower end of a lower section 22 of pipe and telescoped downwardly over the upper end of the cable 16 above the rope socket 18. Thereafter, the upper end of the cable 16 above the pipe section 22 is clamped and the lower clamp at the rope socket 18 is released to allow the pipe section 22 to slide downwardly over and past the rope socket 18. Thereafter, the rope socket 18 is again clamped and an additional pipe section 24 is slid downwardly over the cable 16 above the rope socket 18. The upper end of the cable 16 above the second pipe section 24 is then again clamped and the clamp engaged with the rope socket 18 is released in order that the second pipe section 24 may be slid downwardly over the cable 16 and joined to the first pipe section 22. This process is repeated over and over until the overshot 20 is lowered into engagement with the tool stuck in the bore 12 at the lower end of the cable 16. Thereafter, the overshot 20 may be manipulated to engage and "grab" the stuck tool. Once this is accomplished, the cable is released from the "stuck" tool and drawn up through the tubing sections. The tubing sections may thereafter be raised and removed from the tubing string as the latter is elevated in the bore 12 in order to retrieve the previously stuck tool to the rig floor 14.

However, it is not unusual for the repeated upper and lower clamping of the cable 16 during the process of lowering the tubing string into the well bore 12 for the clamping operations on the cable 16 to manfunction resulting in the cable 16 being accidentally dropped downwardly into the well bore 12. When this occurs, the cable 16 falls completely through the tubing sections 22 and 24 as well as the overshot 20 and to the bottom of the well bore. This, of course, greatly complicates the task of subsequently retrieving the previously stuck tool and also requires that the cable be retrieved.

In order to prevent the cable 16 from dropping completely through the tubing string and the overshot 20 supported from the lower of the tubing string, an abutment assembly referred to in general by the reference numeral 26 is secured to the cable 16 below the rope socket 18 and a tubular sleeve assembly referred to in general by the reference numeral 28 is abuttingly supported from the upper end of the overshot 20 and slidingly receives the cable 16 therethrough. The tubular sleeve assembly 28 defines an upwardly opening socket into which the lower end of the abutment assembly 26 is seatingly receivable. Accordingly, if the cable 16 is accidentally dropped during the "stripping" operation, the cable 16 will drop only so far as allowed by downward movement of the abutment assembly 26 in the tubing string before the abutment assembly 26 seats in the upwardly opening socket of the tubular sleeve structure and thereby terminates downward movement of the abutment assembly 26 as well as the cable 16 through the tubing string.

Figure 4:
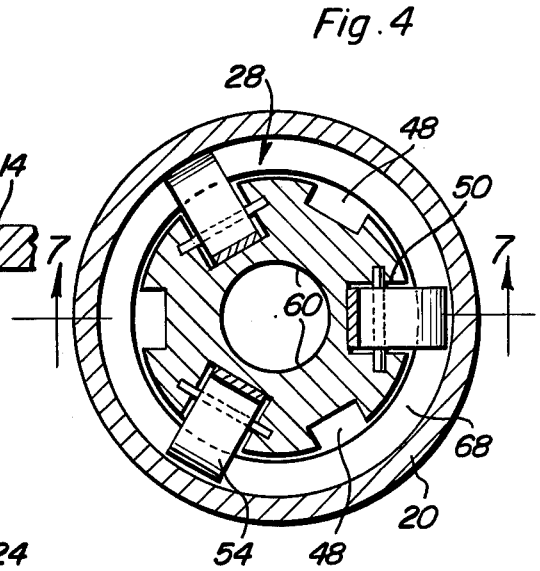
FIG. 4 is an enlarged horizontal sectional view taken substantially upon the plane indicated by the section line 4—4 of FIG. 3.
Figure 5:
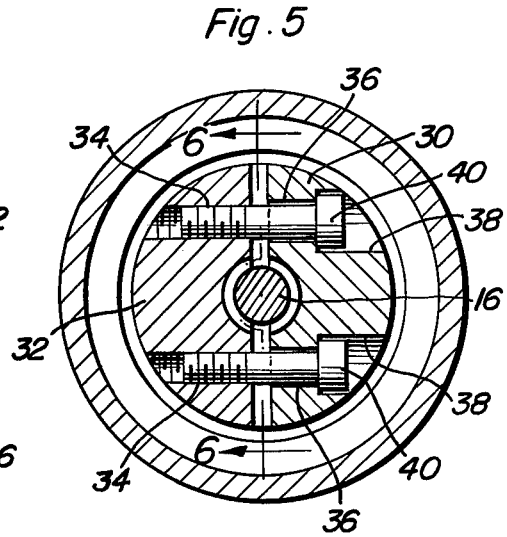
FIG. 5 is an enlarged horizontal sectional view taken substantially upon the plane indicated by the section line 5—5 of FIG. 3.
Figure 3:
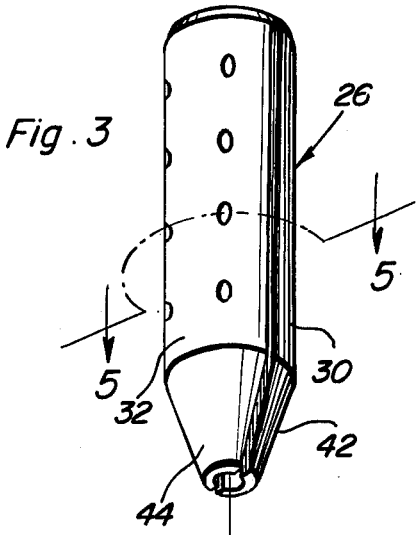
FIG. 3 is an exploded perspective view of the two components comprising the cable stop of the instant invention.
Figure 8:
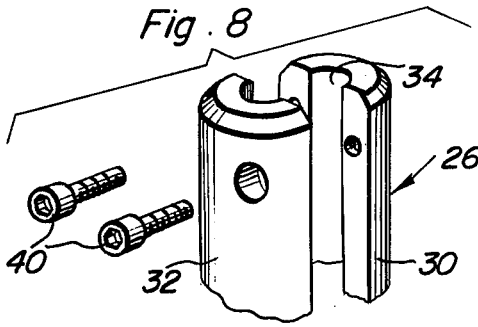
FIG. 8 is a fragmentary exploded perspective view of the upper end of the abutment portion of the cable stop.
Figure 9:
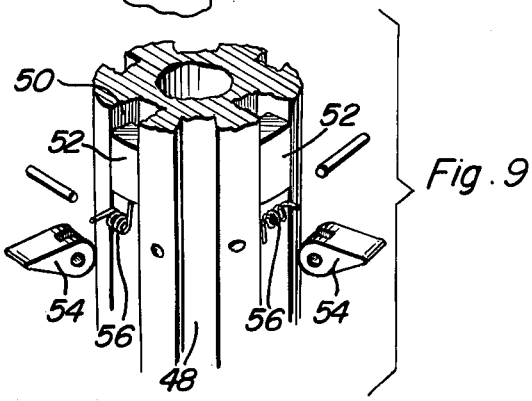
FIG. 9 is a fragmentary exploded perspective view of the vertical mid-portion of the tubular sleeve structure component of the cable stop.
Figure 6:
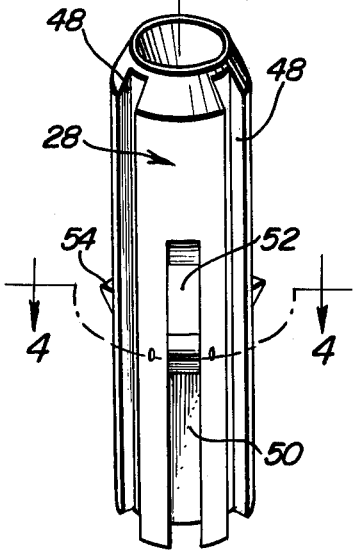
FIG. 6 is a vertical sectional view taken substantially upon the plane indicated by the section line 6—6 of FIG. 5.
Figure 6:
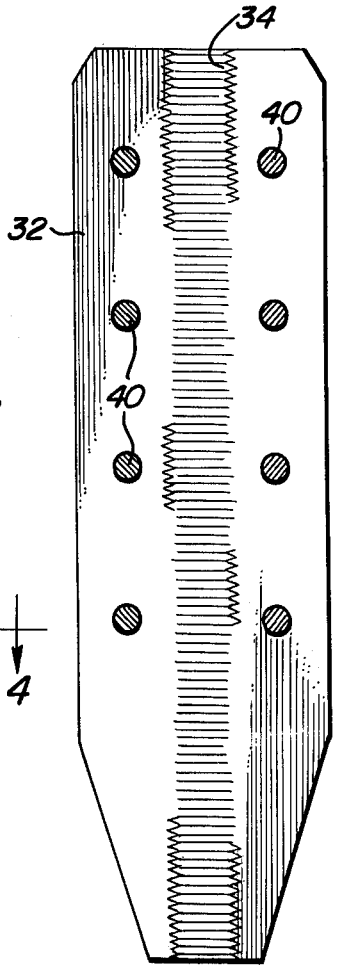
Figure 7:
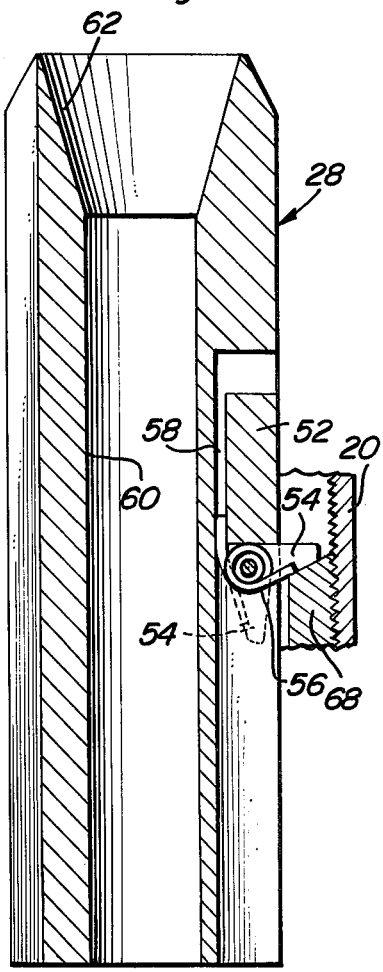
FIG. 7 is a vertical sectional view taken substantially upon the plane indicated by the section line 7—7 of FIG. 4.

With reference now more specifically to FIGS. 3-9 of the drawings, it may be seen that the abutment assembly 26 comprises a pair of sleeve halves 30 and 32 defining threaded semi-cylindrical opposing recesses 34. The sleeve half 32 includes longitudinally spaced pairs of threaded bores 34 and the sleeve half 30 includes longitudinally spaced pairs of smooth bores 36 formed therein including counterbores 38 at one pair of corresponding ends. The sleeve halves 30 and 32 may be secured together by means of headed fasteners 40 passed through the bores 36 and threadedly engaged in the bores 34 after the sleeve halves 30 and 32 have been disposed on opposite sides of the cable 16 and the threads 34 of the sleeve halves 30 and 32 bite into and clampingly engage opposite side portions of the cable 16 thereby securely fastening the abutment assembly 26 to the cable 16. The lower ends of the sleeve halves 30 and 32 include half conical surfaces 42 and 44 which together define a downwardly tapering conical abutment surface.

The tubular sleeve assembly 28 includes three circumferentially spaced and longitudinally extending grooves 48 formed in its outer surface. The grooves 48 open generally radially outwardly of the tubular sleeve assembly 28 and through the opposite ends thereof. The grooves 48 comprise fluid bypass grooves. In addition, the tubular sleeve assembly 28 additionally includes shorter circumferentially spaced and longitudinally extending grooves 50 spaced intermediate the grooves 48 and the upper end of each groove 50 has a stop block 52 secured therein spaced outwardly of the radially innermost extremity of the groove 50. A stop catch 54 is pivotally mounted in each groove 50 immediately below the corresponding stop block 52 and a butterfly spring 56 is operatively associated with each stop catch 54 and the associated stop block 52 whereby the stop catch 54 is spring biased toward the soldered line position thereof illustrated in FIG. 7 projecting outwardly of the outer periphery of the tubular sleeve assembly 28. The stop catches 54, however, may be retracted inwardly against the biasing action of the butterfly springs 56 to the phantom line positions thereof illustrated in FIG. 7.

The stop blocks 52 are spaced below the upper ends of the groove 50 and fluid flow passages 58 are therefore formed behind the stop blocks 52 for the passage of well fluid downwardly therethrough in order to clean the area of the grooves 50 immediately below the stop catches 54 in the event these areas become clogged to prevent retraction of the stop catches 54.

The tubular sleeve assembly 28 defines a cylindrical bore 60 extending therethrough and the upper end of the bore 60 defines an upwardly flared conical socket 62 in which the lower conical end of the abutment assembly 26 is seatingly engageable in the event the cable 16 is accidentally dropped downwardly through the tubing string from which the overshot 20 is supported. The outwardly projecting portions of the stop catches 54, when the latter are extended, engage and support the tubular sleeve assembly 28 from a stop member 68 provided therefor and secured in the upper end of the overshot 20. Thus, it may be seen that the cable stop comprising the assemblies 26 and 28 will be fully operative to prevent the cable 16 from falling completely through the tubing string from which the overshot 20 is supported. Of course, when the overshot 20 is upwardly withdrawn from the well, the assemblies 26 and 28 as well as the "caught" cable 16 are also retrieved.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a sleeve assembly for disposition about a stuck tool support cable immediately above a tubing string supported overshot passed downwardly over said cable during a stripping operation, said sleeve assembly including inwardly retractable outwardly projecting abutment means for engagement with the overshot and support of said sleeve assembly therefrom, and an abutment assembly for removable secure attachment to said cable adjacent the upper end thereof, said sleeve and abutment assemblies including upper and downwardly facing abutment surfaces, respectively, engageable with each other to stop and thereby limit a downward movement of said abutment assembly in the event the cable is dropped and the latter and the abutment assembly fall during the stripping operation, thereby catching the dropped cable by the engagement of the abutment assembly thereon with the overshot supported sleeve assembly and enabling the dropped cable and abutment assembly to be retrieved when the tubing string is pulled from the associated well.

2. The combination of claim 1 wherein said abutment assembly comprises a pair of half cylindrical members including serrated inner surfaces removably clamped together for clamping about said cable.

3. The combination of claim 1 wherein said serrated inner surfaces include coextensive threaded inner surfaces.

4. The combination of claim 1 wherein said sleeve assembly includes peripherally spaced longitudinally extending and outwardly opening fluid bypass grooves formed in the outer surfaces of said sleeve assembly.

5. The combination of claim 1 wherein said sleeve assembly includes a generally cylindrical body having a plurality of peripherally spaced and outwardly opening recesses formed therein in which pivoted catch dogs are mounted for swinging between downwardly and inwardly swung retracted positions and outwardly and upwardly swung outwardly projecting limit positions, and spring means connected between said body and dogs yieldingly biasing said dogs toward said outwardly projecting limit positions.

6. The combination of claim 5 wherein said recesses include stop blocks secured therein spaced outwardly of the inner extremities of said recesses and below the upper extremities thereof, said dogs being disposed beneath said blocks and engaged therewith when in said outwardly projecting limit positions.

7. The combination of claim 6 wherein the spacing between said blocks and the upper and inner extremities of the corresponding recesses define wash passages whereby debris may be washed from those portions of said recesses into which said dogs are retractable.

8. The method of preventing accidental loss of a stuck tool support cable down a well bore during a "stripping" operation wherein a tubing string is lowered down into the bore over the cable with a tubular overshot supported from its lower end for engagement with the stuck tool, whereby the tool may be freed and upwardly retrieved with the tubing string to the surface, said method including supporting a tubular stop sleeve from within the overshot through which the cable is freely slidable, and mounting an abutment on the upper end portion of the cable against shifting therealong and with the abutment of a size sufficiently small to freely receive said tubing sections thereover and yet sufficiently large to prevent its passage through said tubular stop sleeve.

* * * * *